United States Patent [19]

Tabor et al.

[11] Patent Number: 4,772,825

[45] Date of Patent: Sep. 20, 1988

[54] PANEL FOR CONTROLLING LIGHTING SCENE

[75] Inventors: Jim Tabor; Richard Counts, both of Dallas, Tex.

[73] Assignee: Prescolite Inc., San Leandro, Calif.

[21] Appl. No.: 890,863

[22] Filed: Jul. 28, 1986

[51] Int. Cl.[4] ..... H05B 37/00

[52] U.S. Cl. ..... 315/312; 315/313; 315/316; 315/314

[58] Field of Search ..... 315/312, 313, 314, 315, 315/316, 317, 318, 291, 292–298, 320

[56] References Cited

U.S. PATENT DOCUMENTS

| | | | |
|---|---|---|---|
| 3,706,914 | 12/1972 | Van Buren | 315/312 |
| 3,763,394 | 10/1973 | Blanchard | 315/315 |
| 3,946,273 | 3/1976 | Goddard | 315/315 |
| 4,550,276 | 10/1985 | Callaham | 315/312 |

*Primary Examiner*—David K. Moore
*Assistant Examiner*—Michael Razavi
*Attorney, Agent, or Firm*—Bielen & Peterson

[57] ABSTRACT

A panel controlling multiple lighting intensities of a multiplicity of lights in conjunction with a remote lighting dimmer module which utilizes operators mechanically movable to operate potentiometers. Each potentiometer is capable of setting an intensity level of a particular light of the multiplicity of lights. A display is also employed which indicates a lighting level of each of the multiplicity of lights associated with each operator and corresponding potentiometer. The operators and display are supported by a chassis which is mountable in an electrical wall box. Information may be stored which defines a lighting scene in terms of an intensity level of each light of the multiplicity of lights which is set by the operators in the chassis. The intensity level information may be retrieved and transported to a dimmer module which sets the intensity level in each light. One scene may be set into the multiplicity of lights while another scene may be previewed on the display on the chassis.

7 Claims, 9 Drawing Sheets

FIG_1
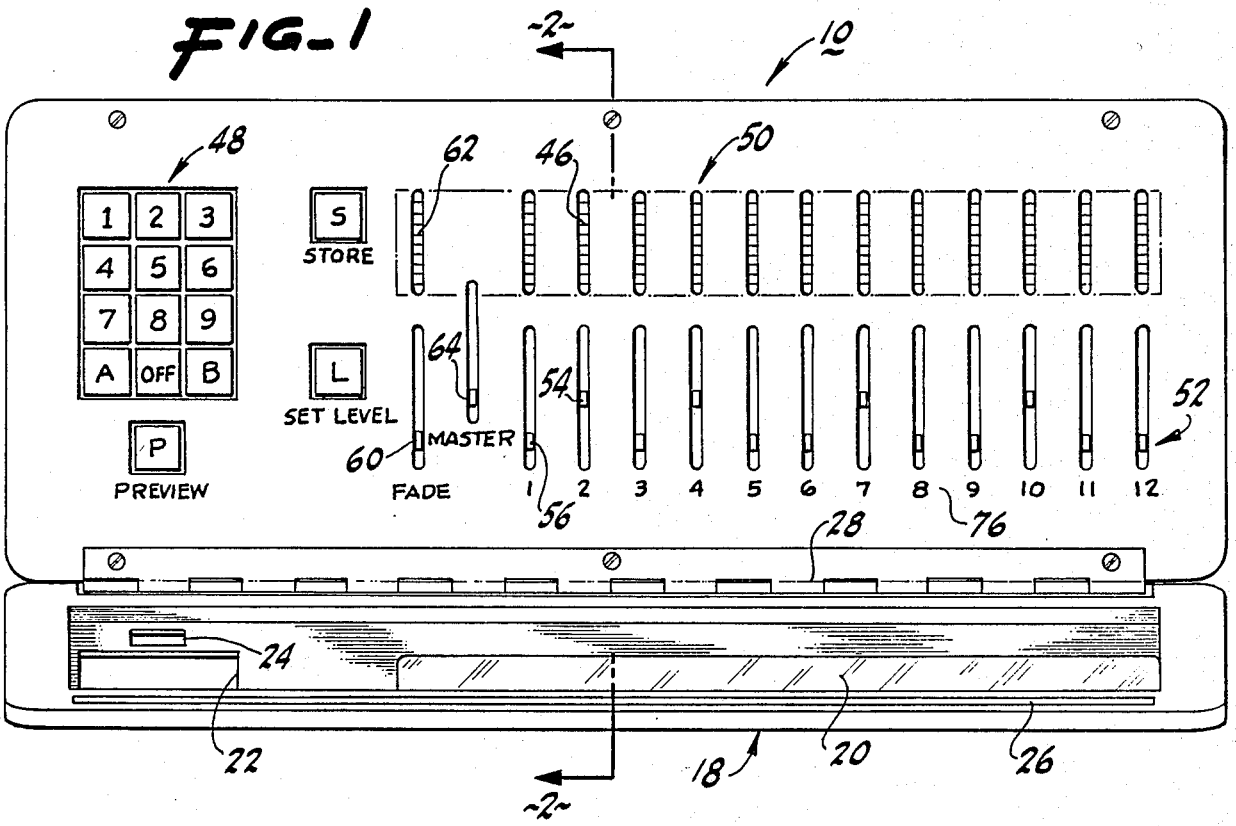
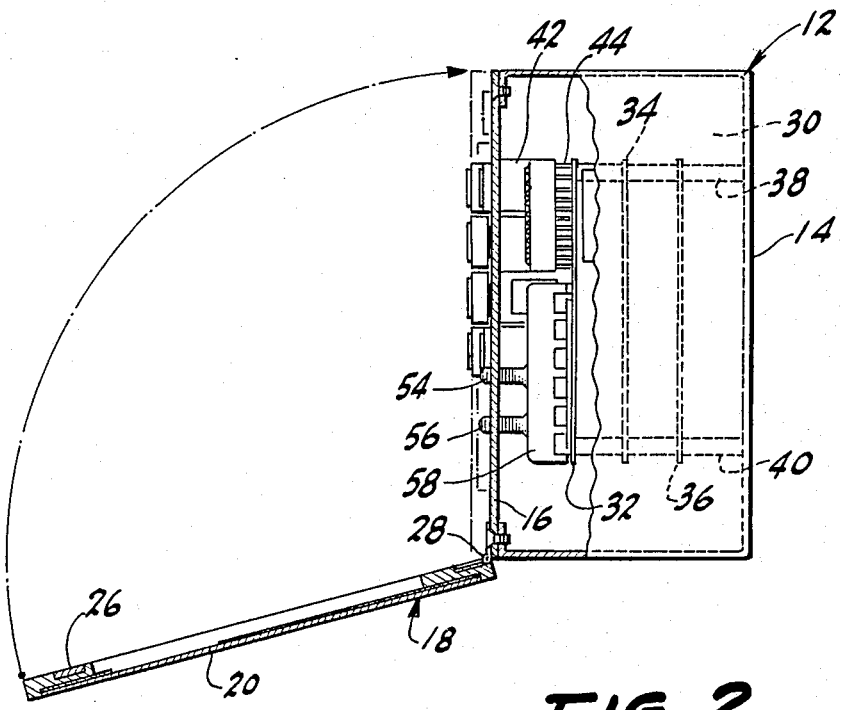
FIG_2

SEE FIG-8
SEE FIG'S-6AND7
SEE FIG-3
U45 LM 3914N
U8 R4R
U9 MC 74HC373N
U10 MC 74HC373N
U11 R2R
U12 MK 48702B
U5A (1/2)
U5B (1/2) MC 1508BCP
U21 MC 1451 6BCP
R35
R36
RV15
R37
R38
Q1
Q2
URI
R7 1M
R9 100K
R26 10K
C39 .001uf
C20 .1uf
C8-1uf
C9
C10
C7 .1uf
C18 10uf
CR1
CR2
+15
+5

PANEL FOR CONTROLLING LIGHTING SCENE

BACKGROUND OF THE INVENTION

The present invention relates to a novel and useful control panel for controlling lighting scenes which exhibits a great degree of versatility.

Scene lighting has been employed in certain facilities which require multiple lights of different intensities. For example a theatre stage, a restaurant, a ballroom, a hotel and the like are susceptible to scene lighting techniques. Each light may be referred to as a "zone" or "channel". Prior lighting controls included the use of a control panel having a series of potentiometers and a remote dimmer module which included the actual electronic devices. The load, which may encompass lights, fan, motors and the like, were connected to the dimmer module, but the voltage level or intensity of the load was controlled from the control panel. For example an ATS system manufactured by Prescolite Controls at Carrollton, Tex. fulfilled this function.

U.S. Pat. No. 4,575,660 describes a control panel which activated four zones of lighting, each zone including a multiplicity of lights.

A panel for controlling multiple zones of lighting which possesses the capability of storing the number of lighting scenes as well as previewing the same without disturbing the lighting level existing in a facility would be a great advance in the lighting field.

SUMMARY OF THE INVENTION

In accordance with the present invention a novel and useful control panel for zone lighting is provided. The control panel of the present invention employs a plurality of operators each mechanically movable to operate a potentiometer. Each potentiometer is capable of setting an intensity level of a particular light of a multiplicity of lights remotely situated from a panel. A dimmer module or pack generally intervenes the plurality of potentiometer operators and the lights being controlled by the operators.

The panel also utilizes a display which indicates the lighting level of each of the multiplicity of lights associated with each operator and corresponding potentiometer. Both the plurality of operators and the display are supported by a chassis which is mountable in an electrical box. Such a display may take the form of an LED bar graph or other visual indication of lighting level. Such bar graphs may be placed immediately adjacent the operators on the panel for convenience.

Means is also provided for storing information defining at least a first and second lighting scene. The embodiments of the present invention possess an ability to control substantially more than a pair of scenes, but two scenes are employed as a functional examplar herein. The information defining the first and second lighting scenes represents the intensity level of each light of a multiplicity of lights which are set by the operators. The information is stored is retrievable and transportable to the remote dimmer module to effect the setting of the intensity of each of the multiplicity of lights. The invention includes means to perform such functions.

The invention also includes means for transporting the intensity level information representing one of the scenes to the display while the multiplicity of lights remain at individual intensities representing another lighting scene. This "preview" function permits the user of a panel to determine the adequacy of a scene before activating the lights to illuminate such a scene.

Means is also provided for determining the rate of fading of the first lighting scene prior to initialization of the second lighting scene. Thus, abrupt changes in lighting levels between scenes is avoided. The panel may include an operator and a display to facilitate the determination of the fading rate of a lighting scene.

In addition, the panel of the present invention may possess the feature of proportionally controlling the intensity of all of the lights utilized in a lighting scene after the intensity level for that scene has been set.

It may be apparent that a novel and useful control panel for scene lighting has been described.

It is therefore an object of the present invention to provide a control panel for scene lighting which is easily integrated into a control system for scene lighting and includes a plurality of channels of control.

It is another object of the present invention to provide a control panel for scene lighting which includes a manual control to override preset scenes.

Yet another object of the present invention is to provide a control panel for scene lighting which includes a variety of operational modes providing great versatility in planning lighting scenes.

Another object of the present invention is to provide a control panel for scene lighting which includes means for determining the fade rate of a scene before the employment of a subsequent lighting scene.

Yet another object of the present invention is to provide the control panel for scene lighting which employs a display which clearly indicates individual zone intensity levels and the fade rate assigned to a scene.

A further object of the present invention is to provide a control panel for scene lighting which permits previewing of any lighting scene without altering the existing room lighting scene.

Another object of the present invention is to provide a control panel for scene lighting which possesses a non-volatile memory.

A further object of the present invention is to provide a control panel for scene lighting which may be used in conjunction with remote stations and includes multiple location playback of lighting scenes.

The invention possess other objects and advantages especially as concerns particular characteristics and features thereof which will become apparent as the specification continues.

BRIEF DESCRIPTION OF THE DRAWINGS

FIG. 1 is a front elevational view of the control panel of the present invention with the hinged face plate in the open position.

FIG. 2 is a sectional view taken along line 2—2 of FIG. 1.

Figure 3:
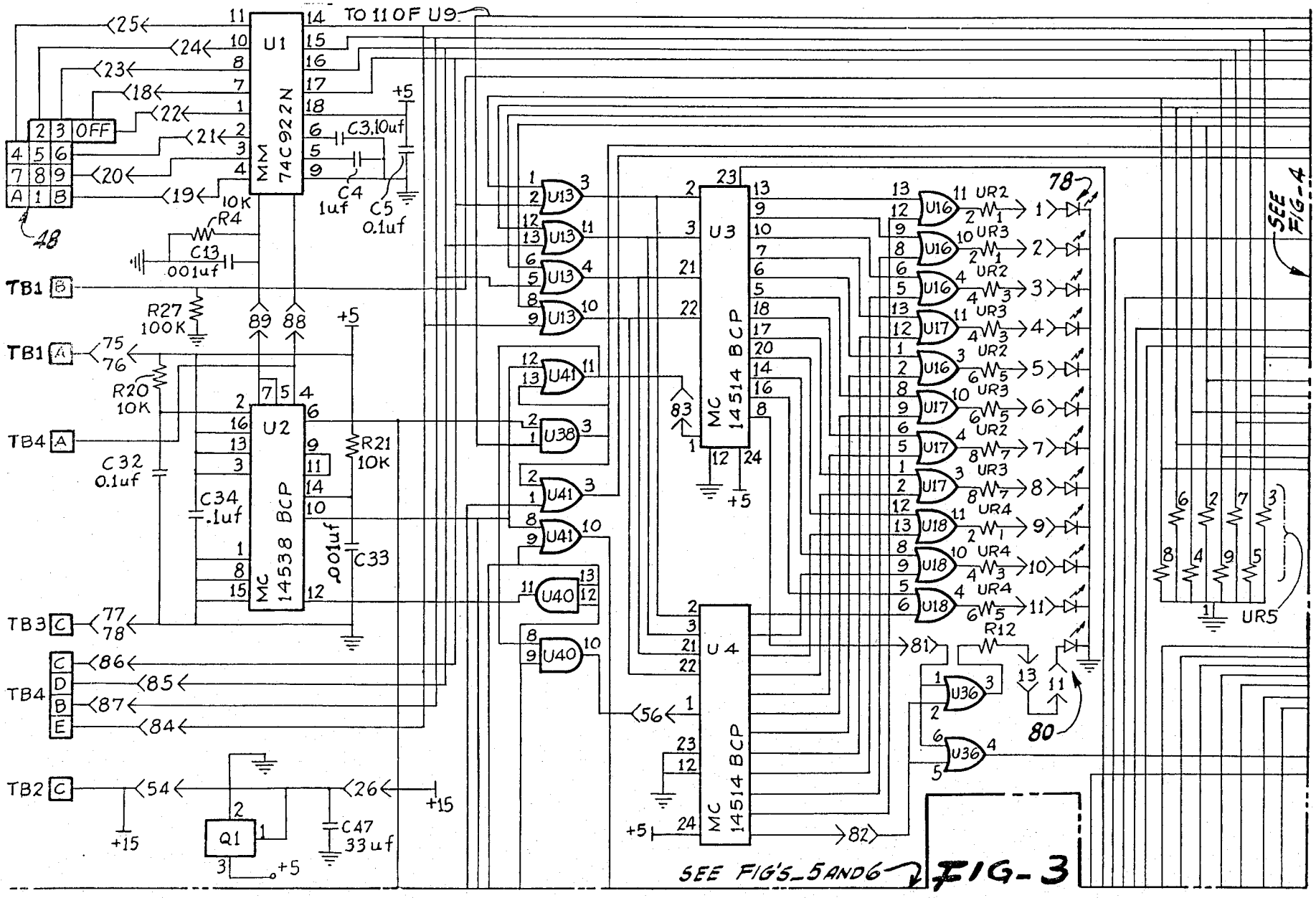
FIGS. 3–9 are schematic electrical diagrams of the circuitry employed in an embodiment of the present invention.
Figure 4:
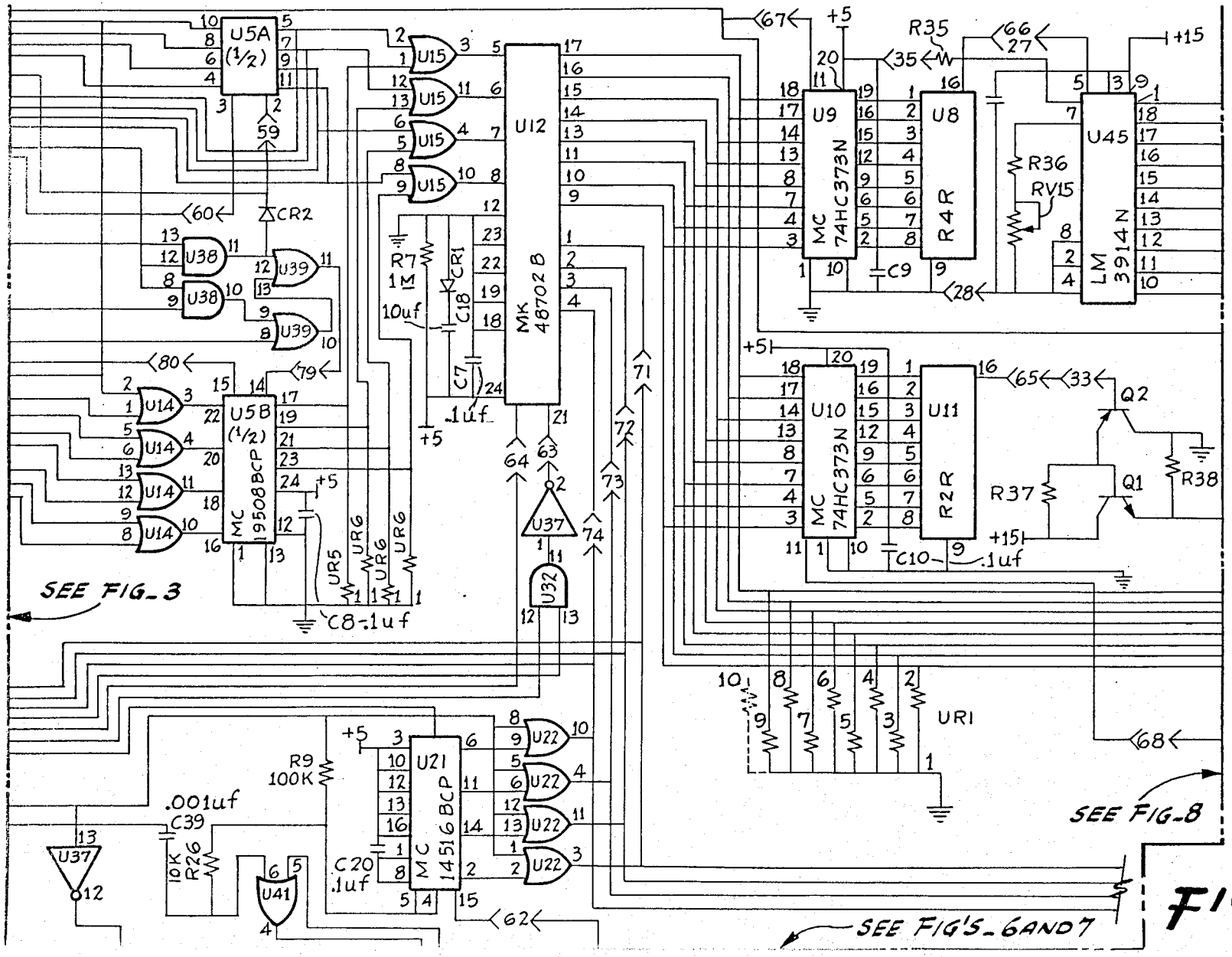

For a better understanding of the invention reference is made to the following detail description of the preferred embodiments thereof which should be referenced to the hereinabove described drawings.

DESCRIPTION OF THE PREFERRED EMBODIMENTS

Various aspects of the present invention will evolve from the foregoing description of the preferred embodiments which should be taken in conjunction with the heretofore described drawings.

The invention as a whole is depicted in the drawings by reference character 10. The control panel 10 includes a chassis 12 which has a dust enclosure 14 and an assembly cover 16. A hinged face plate 18 hingedly attaches to assembly cover 16. Face plate 18 includes translucent portion 20 and openings 22 and 24, to permit viewing of portions of assembly cover 16 when plate 18 is closed. Chassis 12 is capable of fitting with a mounting tube of a standard 3½ inch deep masonry box. With reference to FIG. 2 it may be seen that a magnetic strip 26 holds hinged face plate 18 to assembly cover 16. The latter being constructed of metallic material such as steel and the like. Hinge 28 attaches to hinged face plate 18 and assembly cover 16 as shown in FIG. 2.

The interior chamber 30 of chassis 12 encloses a control printed circuit board 32 and logic printed circuit boards 34 and 36. Fasteners 38 and 40 hold boards 32, 34, and 36 together. Keyboard 32 is also held to control board 32 by jacks 44. It should be noted that various electronic components are found on boards 32, 34, 36, FIG. 2 being representative this of structure by the inclusion of an LED bar graph 46.

Returning to FIG. 1 it may be seen that keyboard 42 terminates in a plurality of scene buttons 48, i.e.: button 1–9 and A and B. Also, included, is an "OFF" button which deactivates the panel 10. It may be further observed that three other buttons are shown designated P, S, L which initiate the "PREVIEW", "STORE" and "SET LEVEL" functions. Also, depicted are a plurality of LED bar graphs or display 50 including bar graph 46 shown in FIG. 2. A plurality of operators 52 numbers 1–12 exist in the form of slide levers which operate potentiometers beneath assembly covers 16. With reference to FIG. 2 it may be seen that operators 54 and 56 are shown as well as potentiometer body 58 associated with operator 54. "FADE" operator 60 associates with LED bar graph 62. The operator 64 for the "proportional" MASTER function does not include an associated LED bar graph.

FIG. 3–9 shows in great detail the schematic of an embodiment of the electronic circuitry of the present invention. Numbers appearing between the spaced chevrons represents the identification of connector pins found on boards 32, 34, and 36 to aid in the electrical connection of the components shown on FIGS. 3–9. The numbers appearing adjacent the conductors connected to component represent the pins of the electrical components. The commercial identification number and value of the components also appears where practible. The designation "TB" indicates the terminal block numbers which also aids in the wiring and assembly of the components on printed circuit boards 32, 34, and 36.

With reference to FIG. 3 it may be seen that push button array 48 addresses the 4-bit encoder U-1. Encoder U-1 outputs a 4-bit address for a particular scene. Capacitor C-5 serves as a filter while capacitors C-3 and C-4 serve as timing capacitors to "de-bounce" the array of push buttons 48. It should be noted that pin 18 of encoder U-1 receives a +5 volt DC input. The remaining components depicted in FIGS. 3–9 also show similar voltage inputs which are similarly denoted. Resistors R-4 and capacitor C-3 serve as a phase shifting network. R-27 is a pull down resistor. Encoder U-1 loads two 4-bit to 1 of 16 decoders U-3 and U-4. Encoder U-1 also loads two 4-bit latches, U-5A and U-5B, FIG. 4.

U-4, a one 4-bit to one of 16 decoder, drives the active scene indicator which would be shown as LED bar graphs 50 which constitute a display. U-3, a second 4-bit to 1 of 16 decoder, drives the PREVIEW scene indicator, which again would be display 50. Decoders U-3 and U-4 drive the same display 50 when not in the PREVIEW mode.

U-5A, a first 4-bit latch, holds the address for the active lighting scene. The second 4-bit latch, U-5B holds the address for the scene to be previewed. Again, when not in the PREVIEW mode, both latches U-5A and U-5B hold the same scene address.

U-6, an analog to digital converter (ADC), converts 1 of 16 analog inputs to an 8-bit word. After each conversion, an end-of-conversion (EOC) signal is produced. The EOC signal clocks a 4-bit up-counter U-21, best shown in FIG. 7. U-21 sequentially clocks the U-6 ADC through the 16 analog inputs. It should be noted "AND" gates and "OR" gate are depicted throughout the schematic shown in FIGS. 3-9. Redundant designations indicate arrays. For example, U-13 represents an integrated circuit with multiple "OR" gates.

The EOC signal from U-6 alternates a flip-flop (FF) U-23 which alternately activates and deactivates the 2-bit latches U-5A and U-5B, as previously stated, holding the addresses for the active and previewed lighting scenes. The EOC driven FF U-23 also alternately enables and disables two digital-to-analog converters (DAC), U-8/U-9 and U-10/U-11). DAC U-8/U-9 and U-10/U-11 are two 8-bit registers each with an R-2-R network each.

Figure 8:
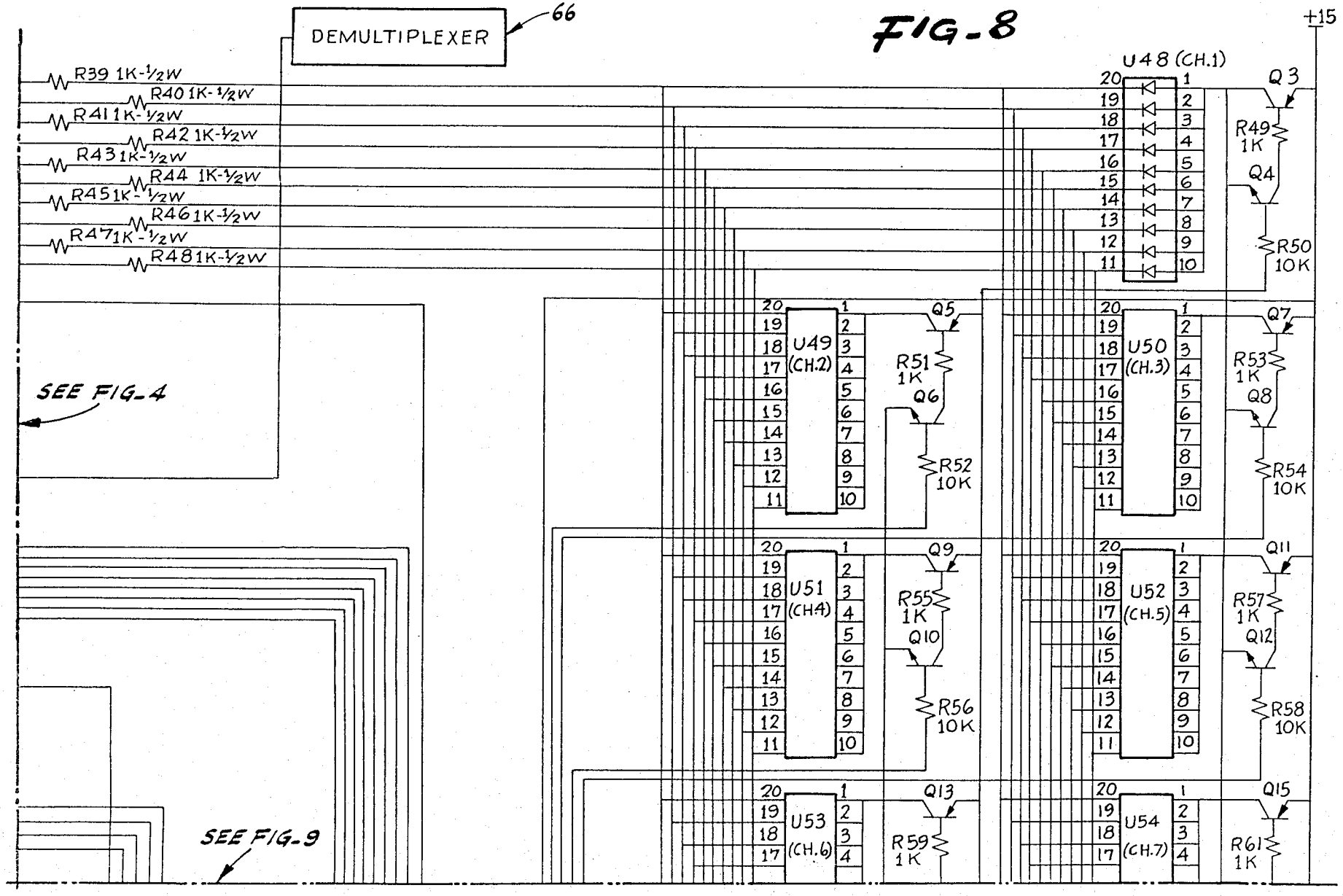
Figure 9:
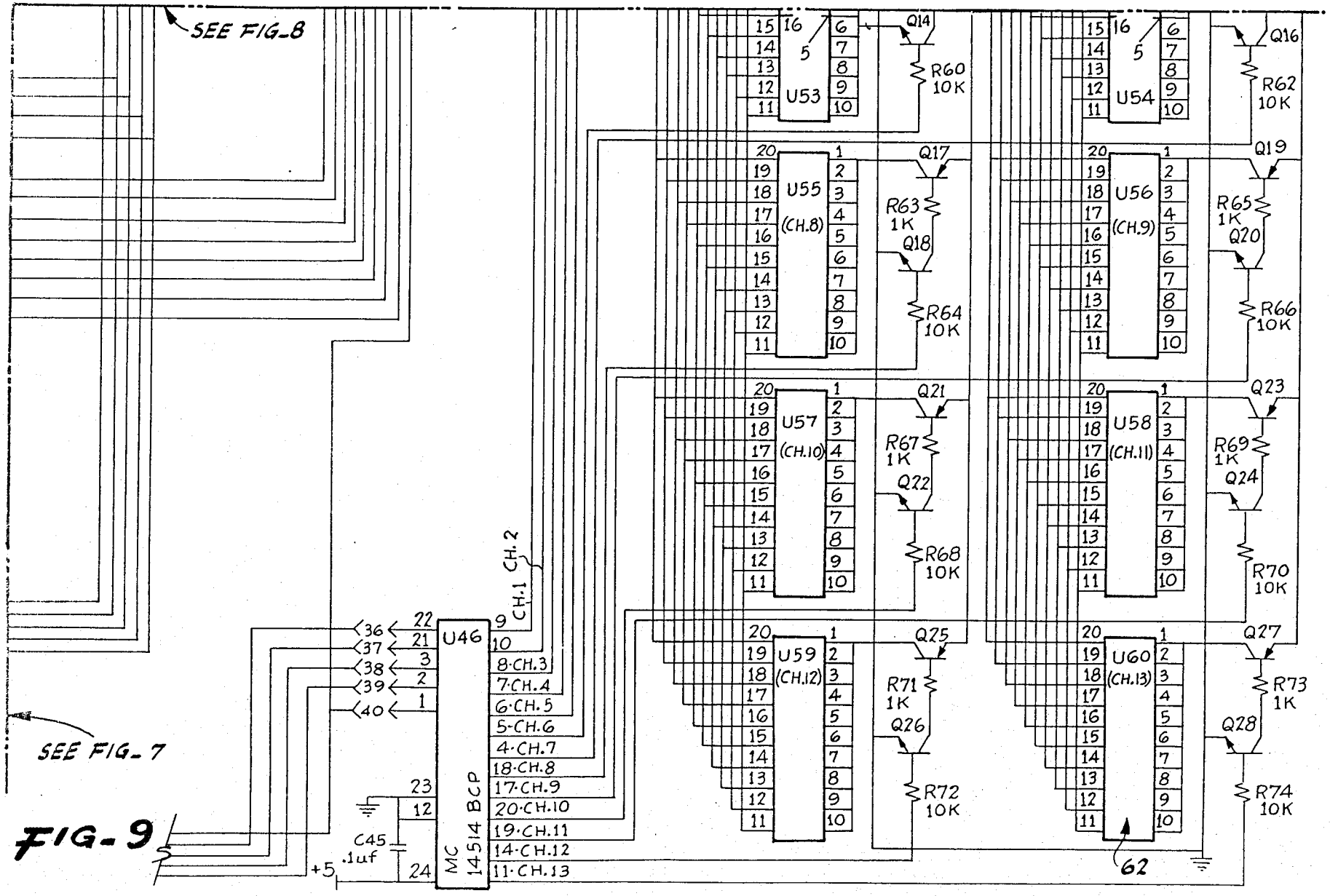

DAC U-8/U-9 outputs to a bar graph display driver U-45. this display driver out-puts to all 13 LED bar graphs U-48-U-59, FIG. 8–9. As previously noted, these bar graphs constitute display 50.

Figure 7:
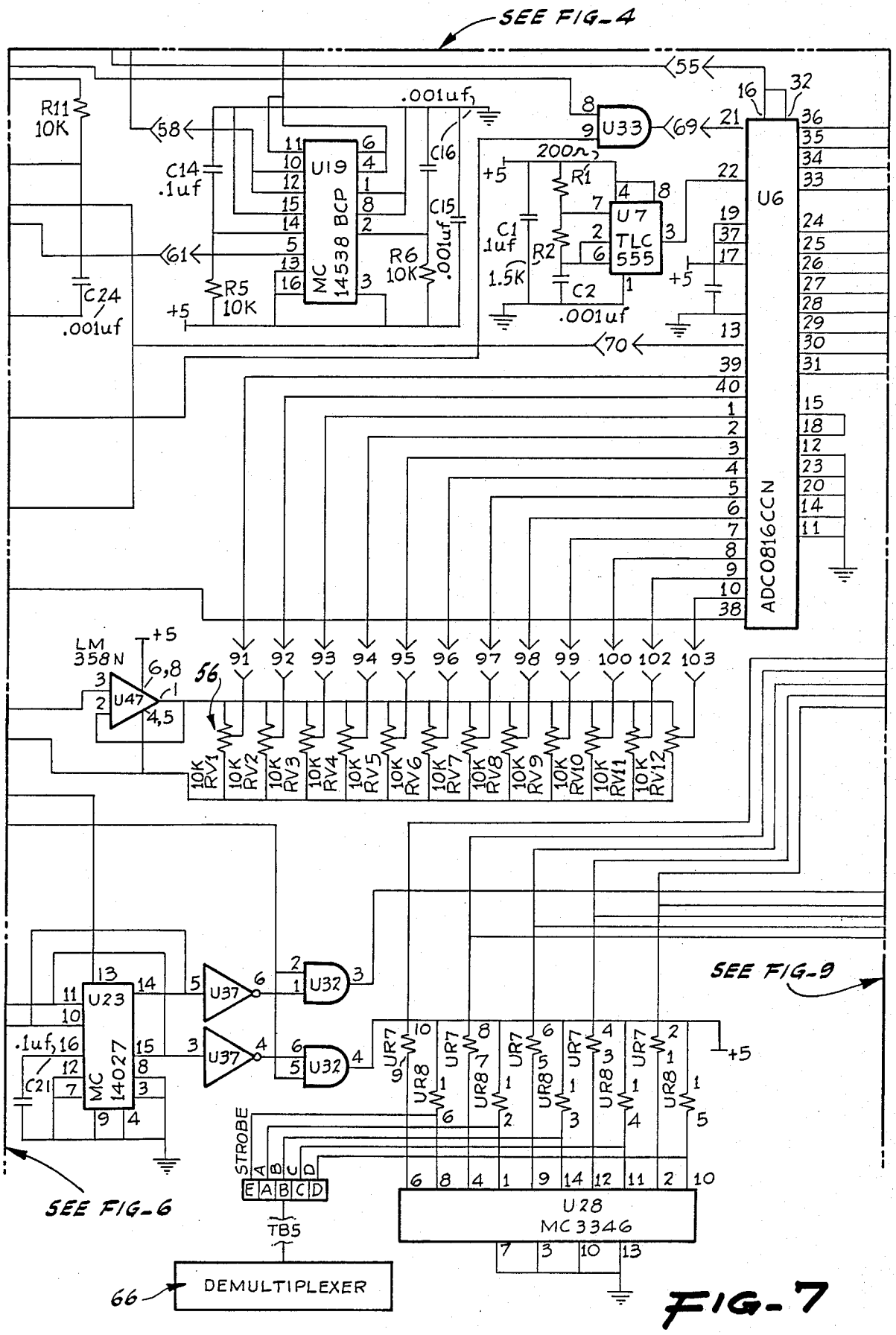
Figure 10:
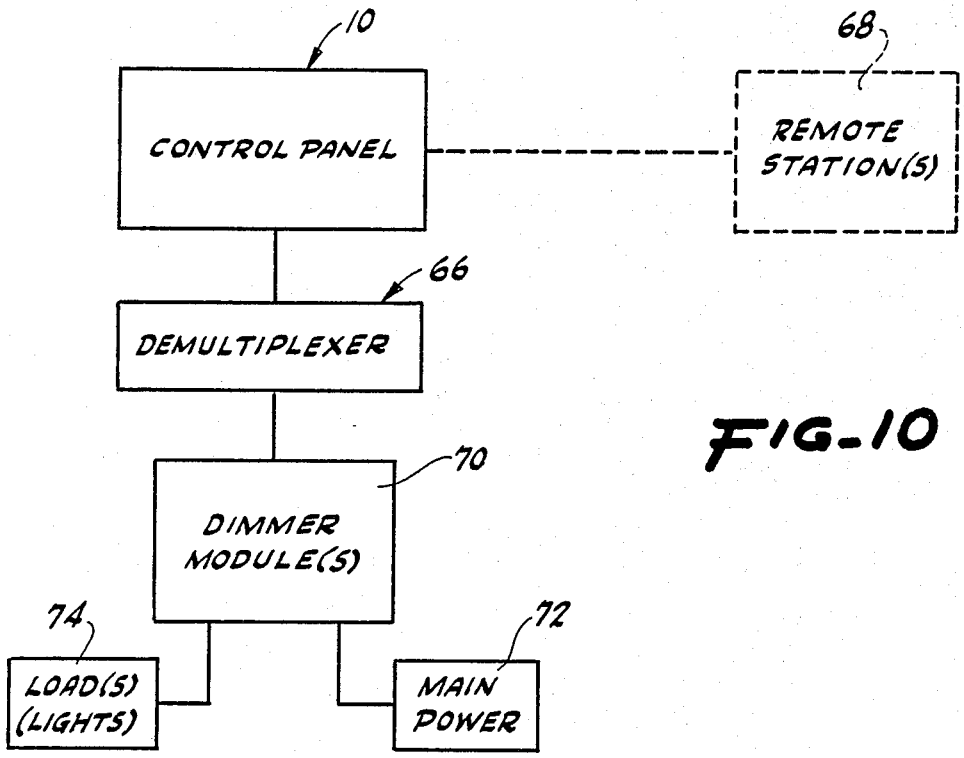
FIG. 10 is a block diagram depicting the environment of the control panel of the present invention in a lighting system.
Figure 11:
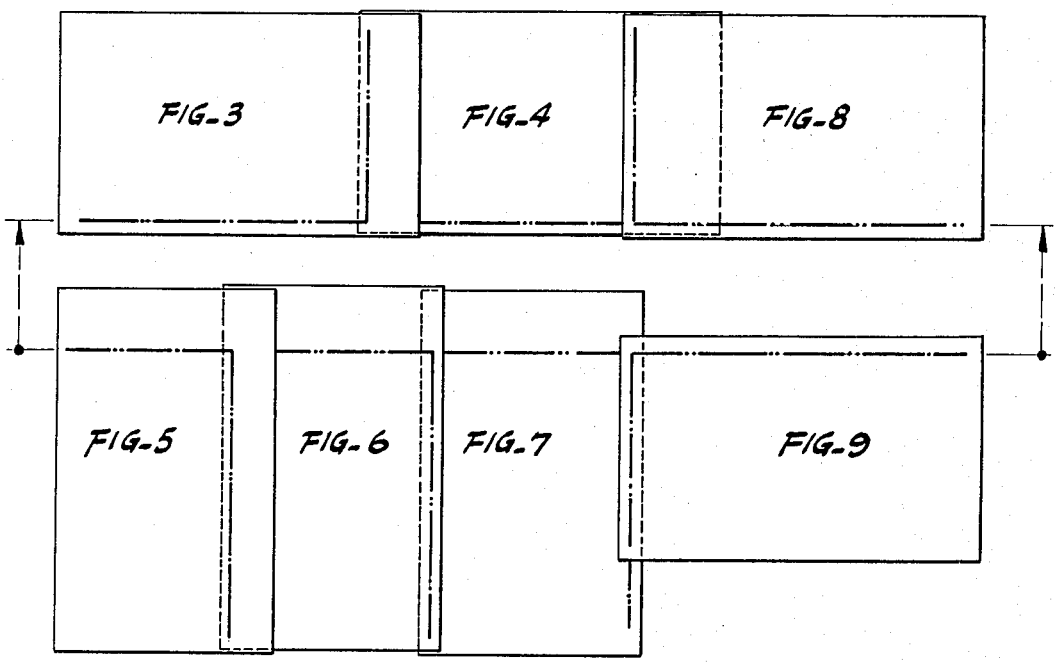
FIG. 11 is a layout of schematic FIGS. 3–9.

EOC U-10/U-11 sends a signal through an amplifier Q-1/Q-2 to demultiplexer66, FIGS. 7, 8 and 10. The EOC driven FF U-23 alternately enables and disables a 4-bit to one of 16 line decoder U-46; FIG. 9, and feeds demultiplexer 66. It should be noted that demultiplexer 66 may be of the type found in a Series-7 control panel manufactured by Prescolite Controls, Carrollton, Tex. Decoder U-46 drives a plurality transistor analog switches, FIGS. 8–9 associated with each LED bar graph U-49-U-60. Each transistor analog switch comprises a combined PNP and NPN transistor with current limiting resistors.

Figure 5:
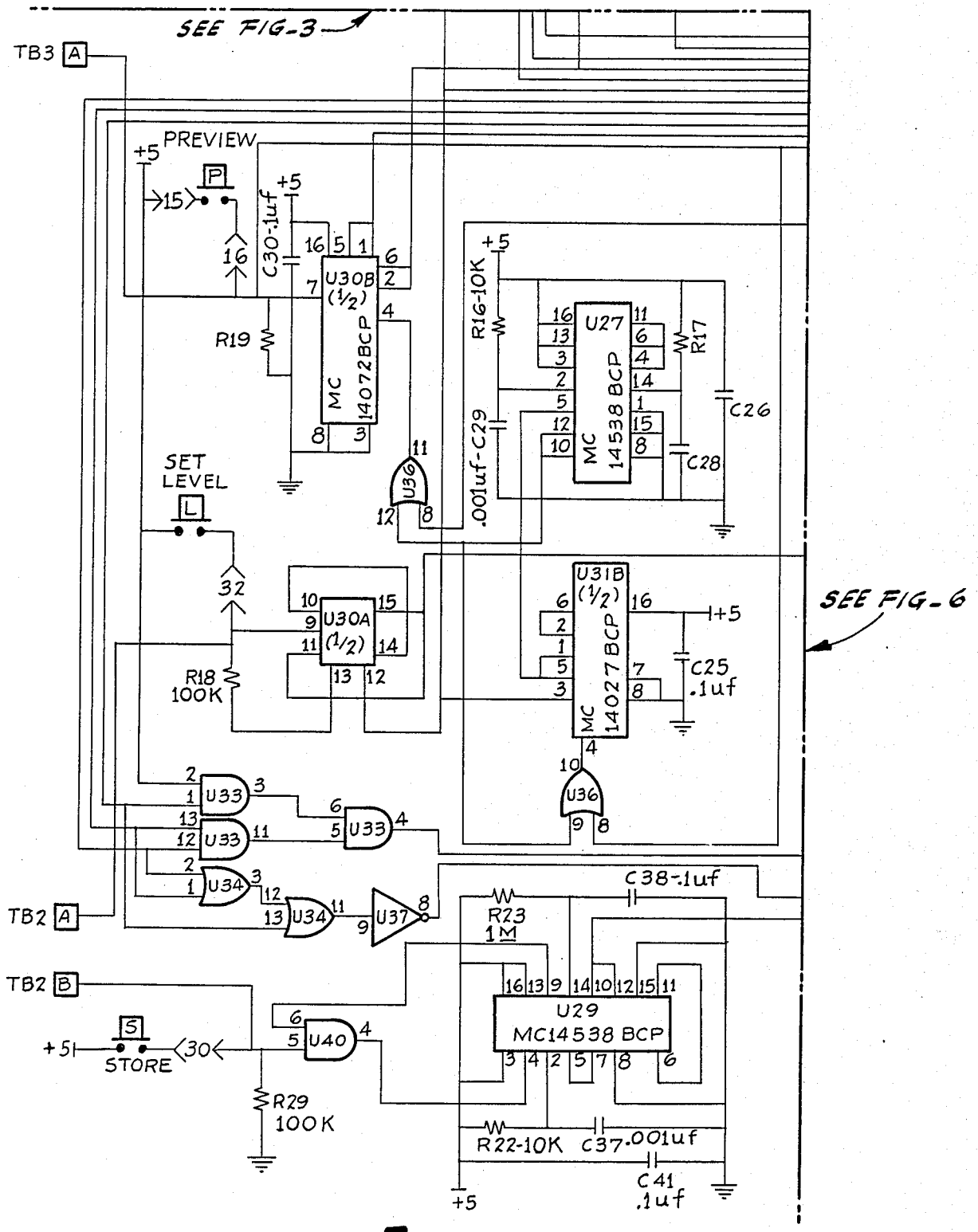
Figure 6:
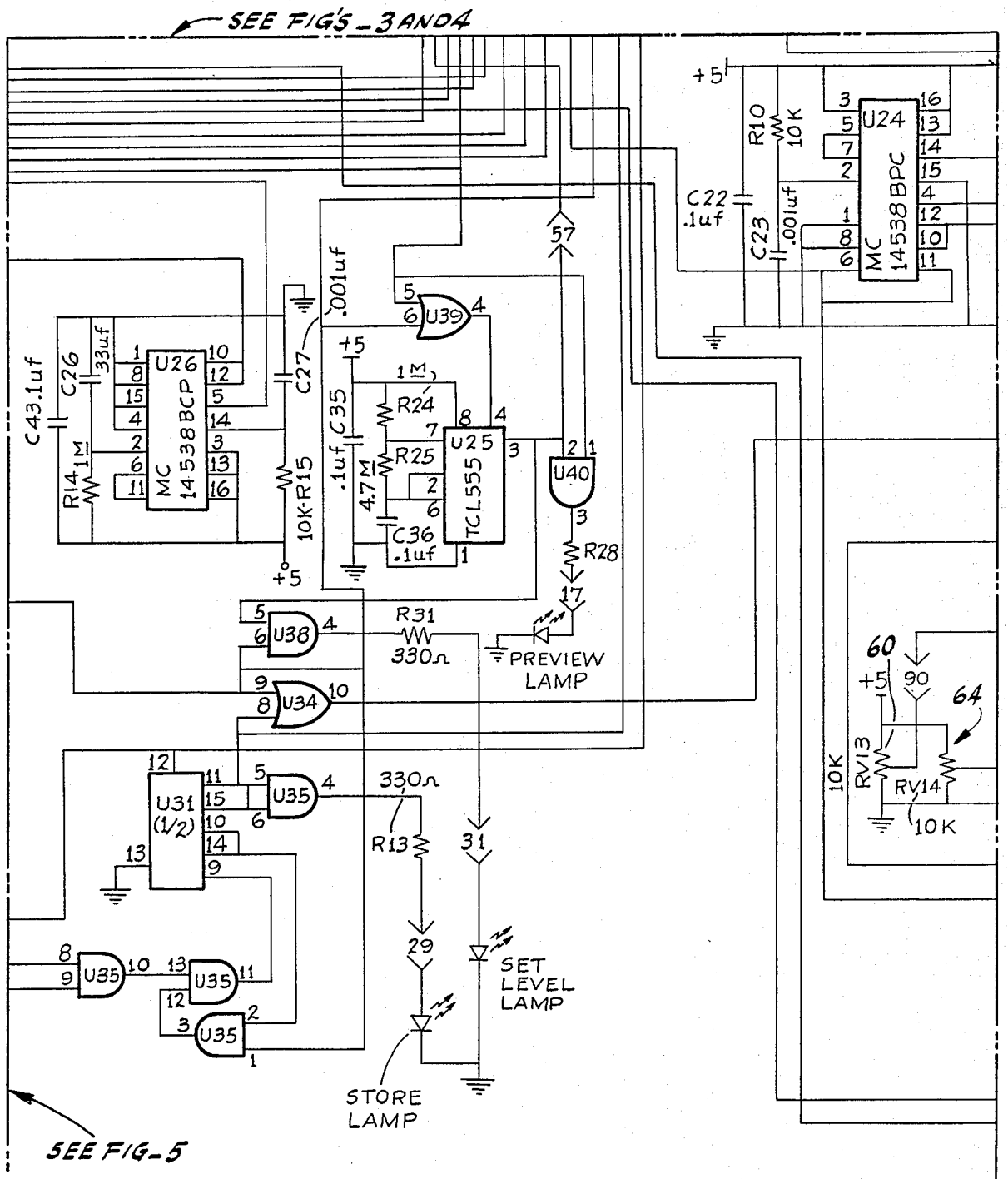

With reference to FIG. 5, the STORE push button enables a 4-bit magnitude comparitor U-33 which clocks a FF U-31. FF U-31A enables the ADC U-6 output and commands the RAM U-12 to write or store the ADC output. The FF U-31A maintains this state until a second 4-bit magnitude comparitor U-35 resets the FF U-31A. Both 4-bit magnitude comparitors U-33 and U-35 are addressed by the 4-bit upcounter U-21. The write or store commands to the RAM U-12 starts at the digital word 0000. The FF U-31A is disabled at digital words 1101, which represents 14 channels (12 intensity settings controlled by operators 52, 1 fade rate setting controlled by operator 60, and 1 OFF signal shown by a button of push button array 48).

The PREVIEW push button (P), FIG. 5, clocks FF U-30B which disables the strobe input of the active scene decoder U-4. At the same time, FF U-30B enables the stroke input of the PREVIEW scene decoder U-3. FF U-30B also activates the low Hz oscillator U-25 which flashes the PREVIEW indicator lamp, FIG. 6. In addition, FF U-30B also enables a 30 second timer, U-26, which maintains the PREVIEW mode for this time period and permits reversion to the active lighting scene mode therafter. FF U-30B further disables the stroke input to the active scene 4-bit latch U-5A during the PREVIEW mode. At this time, pushing any other of the scene push buttons 48 will load a new 4-bit address into the previous scene decoder U-3 and a new 4-bit address into the PREVIEW scene 4-bit latch U-5B. The EOC driven FF U-23 will alternately enable and disable the outputs of the active scene latch U-5A and the previous scene 4-bit latch U-5B. FFs U-27 and U-29 serve to maintain the logic levels associated with the PREVIEW and STORE modes of operation.

Data from the RAM U-12 under the previous scene 4-bit latch U-5B address is loaded to the LED bar graph DAC U-8/U-9 and multiplexed to the LED bar graph displays U-49-U-60 by decoder U-46, previously noted. Decoder U-46 is a 4-bit 1 of 16 type decoder. Data from the RAM U-12 under the active scene 4-bit latch address is loaded into the analog output channels of the DAC U-10-U-11 and multiplexed to the demultiplexer 66.

The 30 second timer U-26, as previously noted, resets the PREVIEW mode of FF U-30B at the end of its cycle. FF U-30B strobes the PREVIEW scene decoder U-4 to load the active scene output in the previous scene decoder U-3. The previous scene 4-bit latch also stroke loads the active scene 4-bit latch U-5B output into the previous scene 4-bit latch U-5B.

With reference to FIG. 10 it may be seen that control panel 10 may optionally be connected to remote stations for multiple location playbacks. Panel 10 provides 12 channels of signals to demultiplexer 66 which sends an analog signal to dimmer module or modules 70 which in turn metes the proper quantity of power from main power source 72 to the loads 74 which are normally lighting fixtures. Loads 74 may also be fans, motors, and the like.

Returning to FIG. 1, panel 10 shows an array of 12 pushbuttons and 14 slide potentiometers. The LED bar graphs 50 indicates slide positions of the slide immediately below the same on a zero to ten scale. It should again be noted that the MASTER slide potentiometer 64 does not include a bar graph. Push button array 48 represents lighting scene numbers (1–9) and letters (A and B) under which intensity levels of the loads 74 are stored. Indicia 76 represents channels 1–12 whose intensity is controlled by plurality operators 52 connected to a potentiometers as previously described.

In operation, intensity levels in channels 1–12 are stored by pressing one of the scene push buttons 48. Button L is then pressed and the intensity levels of the twelve channels are set by operators 56. The fade rate operator 60 may be used at this time; each gradation of LED bar graph 62 representing 6 seconds of fading. At this point the user presses the STORE (S) button to hold this scene intensity information. The same procedure is repeated for other lighting scenes as desired. It should be noted that operators 52 may be connected to various types of lights and/or motors for example, incandescent lights, fluorescent lights, low voltage lights, fans and the like.

After storing the various scenes the panel 10 may be controlled by the stored intensity levels. To retrieve the stored values and operate the dimmer module 70, the user simply presses a scene pushbutton. While operating from the stored levels of intensity the slide potentiometers are inoperative.

A PREVIEW function is provided to "look-ahead" at a scene before activating that particular scene. By way of example, assume that the user is operating in scene 1. Push button 1 is lighted by LED 78 which is one of the plurality of LED 80 for lighting button array 48. The 13 bar graphs, U-49-U-60, of the display 50 show the 12 intensity levels of the loads 74 as well as the fade rate of that particular scene. If the user wishes to know the intensity level stored for scene number 4, the PREVIEW button is pressed and the button "number 4" is also pressed. The PREVIEW push button and the number 4 push button will flash. The display 50 will indicate the stored levels of scene number 4 and the fade rate of the same. However, the dimmer pack or module 70 and the loads 74 will continue to respond to the stored levels of scene number 1. If scene number 4 is acceptable the user will simply press number 4 and the lighting levels for scene 4, previously stored, will pass to loads 74 and display 50 will indicate intensity and fade rate of that scene. If scene number 4 is unacceptable to the user, the user may wish to PREVIEW another scene by using the procedure above delineated or simply press another scene push button to activate another scene into the loads 74. If nothing is actuated after entering the PREVIEW mode, after 30 seconds the PREVIEW function will default back to scene 1. That is to say, display 50 will then indicate the scene 1 intensities and fade rate. At this time, the flashing of the scene 4 push button and the PREVIEW push button will cease. Stored scenes may be activated in any sequence simply by pushing the particular scene button from the button array 48.

The SET LEVEL (L) button permits the user to transfer control from the panel 10 memory to a manually operated mode. At this point the user may move operators 56 to set the intensities of the load 74 to yet another level; a variable "twelth" scene. Subsequent pressing of any of the scene buttons 48 will again transfer the panel 10 to its memory mode.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A panel for controlling multiple lighting intensities of a multiplicity of lights in conjunction with a remote lighting dimmer module comprising:

a. a chassis;

b. a plurality of operators each mechanically movable to operate a potentiometer, each potentiometer being capable of setting an intensity level of a particular lighting channel utilizing the multiplicity of lights;

c. a display simultaneously indicating the lighting level of each of the particular channels of a lighting scene utilizing the multiplicty of lights associated with each operator and corresponding potentiometer, said plurality of operators and said display being supported by said chassis;

d. means for storing information defining at least a first and a second lighting scene, said information defining each lighting scene including information representing the intensity level of each channel of the multiplicity of lights being set by said plurality of operators;

e. means for retrieving said intensity level information of any scene of said first and second lighting scenes from said means for storing information defining said at least a first and a second lighting scene;

f. means for transporting said retrieved intensity level information representing one of said first and second lighting scenes to the remote dimmer module for actuating each of the multiplicity of lights according to said retrieved intensity level information;

g. means for transporting said retrieved intensity level information representing the other of said first and second lighting scenes to said display for indication thereat while the multiplicity of lights remain actuated according to said retrieved intensity level information representing said one of said first and second lighting scenes.

2. The panel of claim 1 which additionally comprises means for determining the rate of fading of said actuated first lighting scene intensity levels of the multiplicity of lights prior to activating said multiplicity of lights according to said stored second lighting scene intensity level information.

3. The panel of claim 1 which additionally comprises means for proportionally controlling the intensity of all of said lights utilized in a lighting scene after being set at intensity levels corresponding to a particular lighting scene.

4. The panel of claim 1 which additionally comprises means for activating said display to represent a one of said first and second lighting scenes while the multiplicity of lights remain actuated at individual intensity levels representing said one of said first and second lighting scenes.

5. The panel of claim 4 in which said display includes a multiplicity of bar graphs.

6. The panel of claim 4 which additionally comprises means for determining the rate of fading of said actuated first lighting scene intensity levels of the multiplicity of lights prior to activation of the multiplicity of lights according to said stored second lighting scene intensity level information.

7. The panel of claim 6 in said means for determining the rate of fading includes an operator and a graphical display supported to said chassis

* * * * *